US006813789B2

(12) United States Patent
Leoutsakos

(10) Patent No.: US 6,813,789 B2
(45) Date of Patent: Nov. 9, 2004

(54) BED TRANSFER ASSIST METHOD AND APPARATUS

(76) Inventor: Thomas Leoutsakos, P.O. Box 253, Medford, MA (US) 02155

( * ) Notice: Subject to any disclaimer, the term of this patent is extended or adjusted under 35 U.S.C. 154(b) by 0 days.

(21) Appl. No.: 10/241,848

(22) Filed: Sep. 13, 2002

(65) Prior Publication Data

US 2004/0049855 A1 Mar. 18, 2004

(51) Int. Cl.[7] ..... A47C 31/00

(52) U.S. Cl. ..... 5/662; 5/424; 5/426

(58) Field of Search ..... 5/662, 426, 429, 5/424, 504.1, 505.1

(56) References Cited

U.S. PATENT DOCUMENTS 5,435,028 A * 7/1995 Frala ..... 5/662

* cited by examiner

*Primary Examiner*—Teri Pham Luu
*Assistant Examiner*—Fredrick Conley
(74) *Attorney, Agent, or Firm*—G Kersey

(57) ABSTRACT

Method and apparatus for assisting transfer into and out of a bed by a handle for engagement by a person seeking to transfer into or out of a bed, with the handle positioned aside the bed, and accompanied by a member for counteracting torque exerted by the handle when a person is seeking to transfer into or out of a bed; the torque is counteracted by an elongated member associated at a right angle with respect to the handle and an elongated tube for positioning the handle under a mattress.

18 Claims, 4 Drawing Sheets

BED TRANSFER ASSIST METHOD AND APPARATUS

BACKGROUND OF THE INVENTION

This invention relates to a method and apparatus for assisting persons in transferring into and out of a bed.

The act of transferring into and out of a bed, as well as maneuvering in the bed may be difficult for some persons, particularly those who are elderly or disabled.

As a result, a wide variety of manual support devices, which are associated with a bedframe, have been provided.

However, these prior devices are often cumbersome, unstable, expensive, and difficult to store.

Accordingly, it is an object of the invention to facilitate the transfer of persons into and out of a bed, and maneuvering with respect to the bed.

Another object of the invention is to assist persons who have difficulty in transferring into and out of a bed, as well as maneuvering in the bed, particularly those who are elderly or disabled.

A further object of the invention is to overcome the objections associated with a wide variety of currently-available manual support devices which are attachable to a bedframe.

Still another object of the invention is to provide a bed transfer device that is not cumbersome, expensive, and difficult to store and use.

Yet another object is to stabilize bedframes.

SUMMARY OF THE INVENTION

In accomplishing the foregoing and related objects, the invention for assisting transfer into and out of a bed by providing a handle for engagement by a person seeking to transfer into or out of a bed; positioning the handle aside the bed; and counteracting torque exerted by the handle when a person is seeking to transfer into or out of the bed.

In accordance with one aspect of the invention the positioning is by a member positioned under a component of the bed, for example, an elongated tubular member which is attached to the handle.

In accordance with a further aspect of the invention, the counteraction of torque is by an elongated member associated with the handle and the positioning member, and positioned at a right angle in relations to an elongated tubular member attached to the handle. The counteracting member can be an elongated bar that is slidably inserted through an aperture of the combination of the handle and the positioning member.

In accordance with yet another aspect of the invention, the handle can be a tubular member that extends from a first positioning member, which can be tubular, to a second positioning member, which also can be tubular. The handle can be asymmetric and reversible with respect to the first and second positioning members.

In accordance with a method of the invention for assisting transfer into and out of a bed, the steps include (a) providing a handle for engagement by a person seeking to transfer into or out of a bed; (b) positioning the handle aside the bed and attaching it to a member for securing the handle with respect to the bed, and (c) counteracting torque exerted by the handle when a person is seeking to transfer into or out of a bed.

The method can include the step of positioning and attaching the handle under a component of the bed to an elongated tubular member. The attaching step can provide for removably attaching the handle. The method provides for counteracting torque by inserting an elongated member with respect to the handle and the positioning member, with the elongated member positioned at a right angle to the elongated member and slidably inserted through an aperture of the combination of the handle and the positioning member.

The method also includes the step of providing the handle as a tubular member that extends from a first positioning member, as an elongated tube, to a second positioning member, as an elongated tube. The handle can be an asymmetric and reversible member with respect to the first and second positioning members.

DETAILED DESCRIPTION

Figure 1:
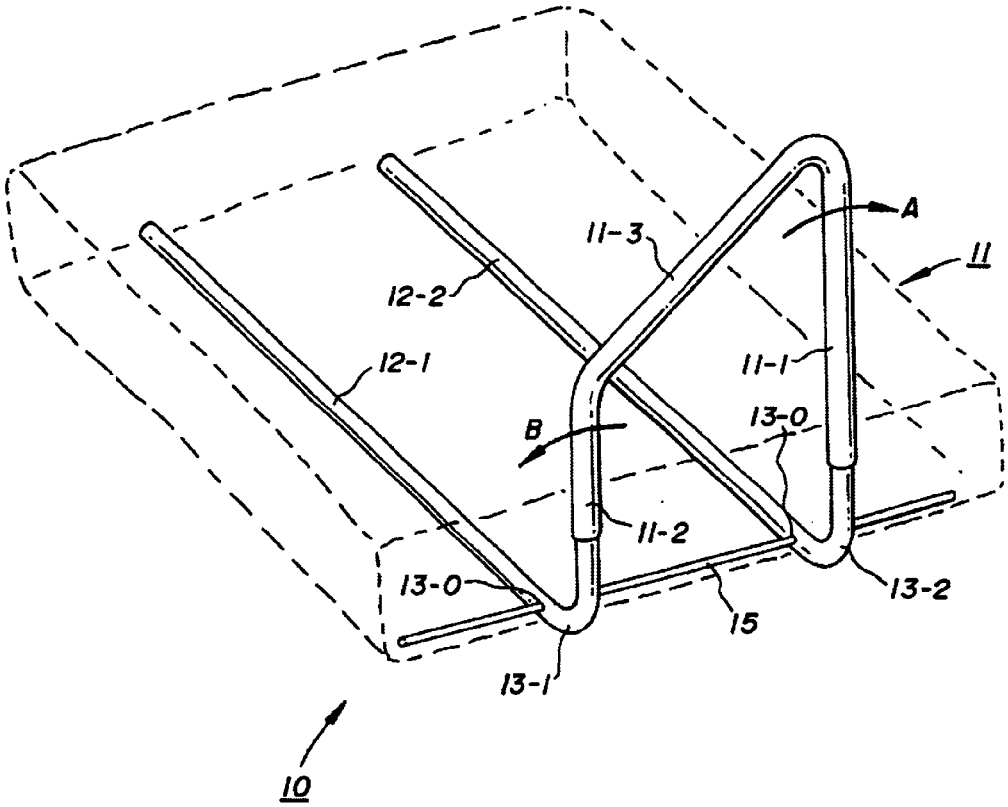
FIG. 1 is a perspective view of an apparatus, in accordance with the invention, for assisting persons in transferring into and out of a bed.

With respect to the drawings in FIG. 1, apparatus 10, in accordance with the invention, for assisting persons in transferring into and out of a bed is formed by an assist handle 11 which is removably attached to a first support tube 12-1 and a second support tube 12-2. The support tubes 12-1 and 12-2 are inserted under a component of a bed, such as a Mattress (shown in phantom).

Because of the simplicity of the transfer assist arrangement, a person holding onto the assist handle 11 applies a torque. The invention mitigates against any adverse torque effect by providing an under-mattress support bar 15. In the absence of the support bar 15, torque could cause the support tubes 12-1 and 12-2 to rotate upwardly. If the center of torque is at the elbow 13-2 of the tube 12-2, the rotation would be in the direction indicated by the arrow A. On the other hand, if the center of torque is at the elbow 13-1 of the tube 12-1, the rotation would be in the opposite direction indicated by the arrow B.

In addition, the support bar 15 also serves to distribute weight applied to the underlying mattress when occupied.

The assist handle 11 is asymmetric and reversible with respect to the support tubes 12-1 and 12-2. As shown in FIG. 1, the assist handle is in the form of a half trapezoid with a long arm 11-1 opposite a short arm 11-2 with the arms 11-1 or 11-2 connected by a diagonal portion 11-3, the end of the arm 11-2 is slidably positioned within or over the end of the support tube 13-1. Similarly, the end of the arm 11-1 is slidably positioned within or over the end of the support tube 13-2. In FIG. 1, the ends of the assist handle 11 are positioned over their respective support tubes.

The under-mattress support bar 15 is slidably inserted through apertures in the combination of the support tubes and assist handle. In FIG. 1, the support bar 15 passes through an opening **13-*o* of the support tube 13-2 and a similar opening 13**-*o* of the support tube 13-1. It will be appreciated that the handle 13, attached to the support tubes above their end curvatures, beyond, for example, a mattress overlying the extended portions of the support tubes, can pass through extensions of the handle 13 which provide a curvature similar to that shown for the support tubes in FIG. 1. The length of the support bar 15 depends upon the extent of the anticipated torque. For that purpose, support bars 15 of different lengths can be provided.

Figure 2:
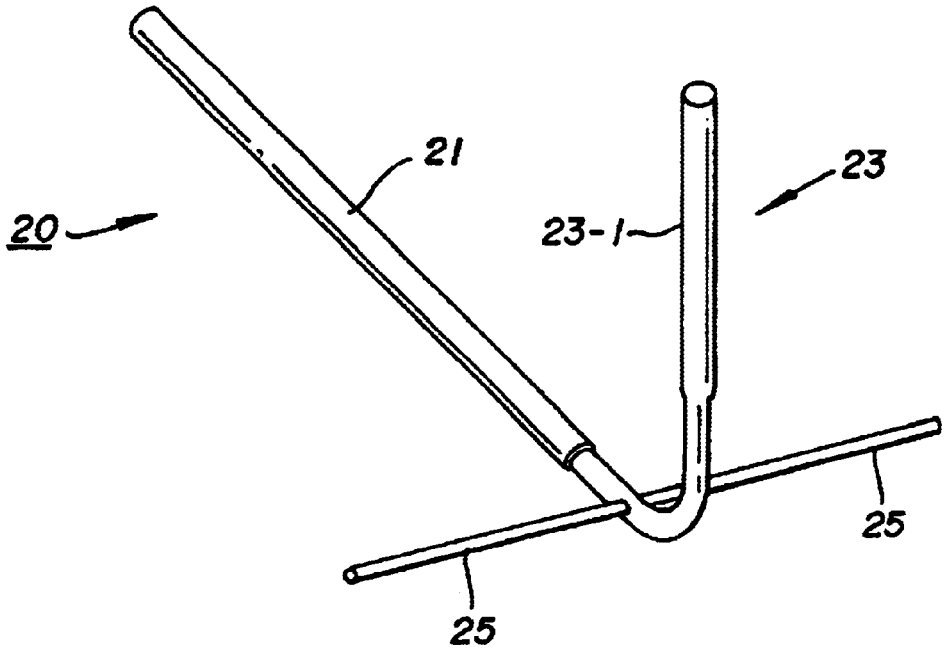
FIG. 2 is a perspective view of an alternative embodiment of the invention.

In the alternative embodiment 20 of FIG. 2 a single support tube 21 is employed and is attached to an assist handle 23 with a single arm 23-1 which is attached to a support tube 21 beyond the curvature of the handle 23 where the anti-torque support bar 25 is inserted.

Figure 3:
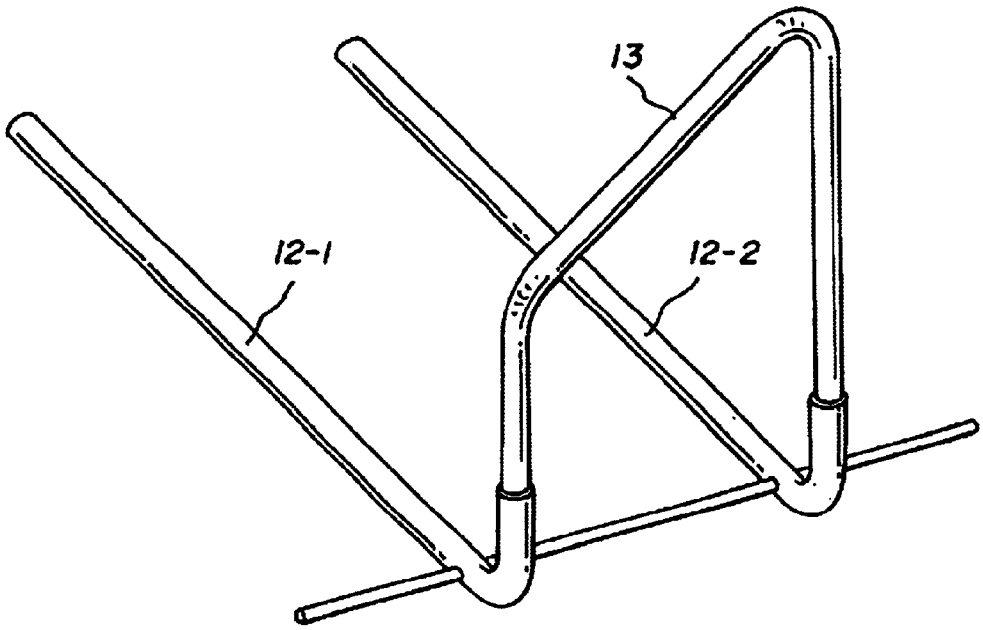
FIG. 3 is a perspective view showing one mode of attaching the handle of the invention to a member that supports the handle with respect to a bed.

In FIG. 3, an alternate mode of attaching the handle 13 of the invention to a support tube 12-1 is by having the end of the handle slidably received within the bore of the support tube 12-1, by contrast with the showing in FIG. 1, where the end of the handle 13 envelops the end of the support tube 12-1.

Figure 4:
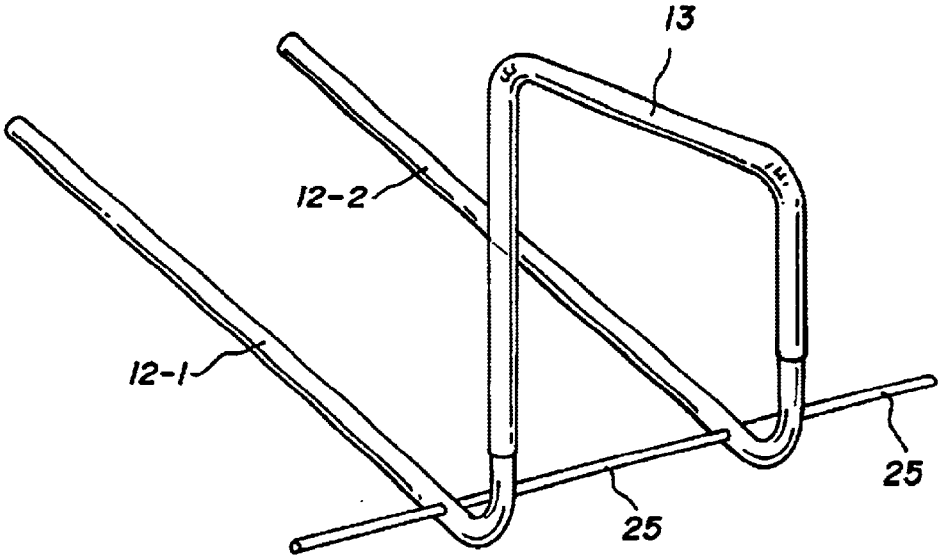
FIG. 4 is a perspective view showing another mode of attaching the handle of the invention to a member that supports tile handle with respect to a bed.

In FIG. 4 the assist handle 13 of FIG. 1 is reversed in relation to the support tubes 12-1 and 12-2. This is to assist elevation of a person lying in bed by holding and pulling against the long arm of the handle 13. This is by contrast with the showing in FIG. 1 where the long arm is positioned to assist it person getting into as opposed to getting out of a bed. Because of the reversibility, the handle provides a convenient way of adapting to the specific needs of a user.

Figure 5:
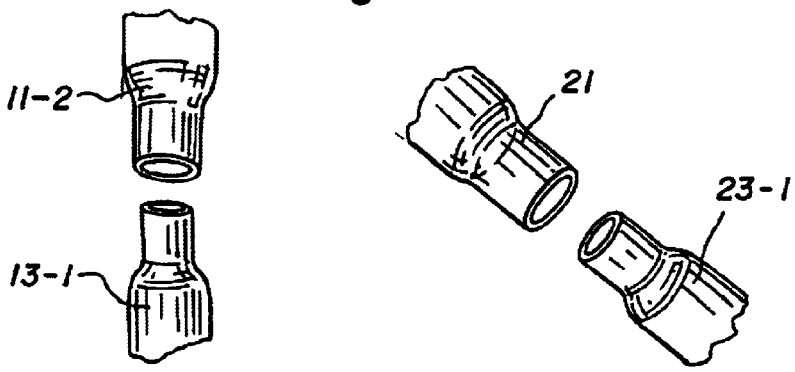
FIG. 5 is a perspective view showing one form of modification for resisting rotation of tubular members employed in the invention.

In FIG. 5, the circular ends of tile tubes in FIGS. 1 and 2 are flattened to form an elliptical end 12-*e* which is either received by or received within a corresponding elliptical end (not shown) of the other tube to which connection is to be made. Because of the elliptical configurations of the ends, there is a resistance to rotation so that the slidably connected tubes are stabilized with respect to each other.

It will be understood that the foregoing detailed description is illustrative only and that other modifications and adaptations of the invention may be made without departing from the spirit and scope of the invention as defined in tile appended claims.

What is claimed:

1. Apparatus for assisting transfer into and out of a bed, comprising:

a handle for engagement by a person seeking to transfer into or out of a bed;

means having opposite sides for positioning said handle aside said bed; and tubular means extending beyond said opposite sides of the positioning means for counteracting torque exerted by said handle when a person is seeking to transfer into or out of a bed; wherein the positioning means comprises means positioned under a component of said bed with the counteracting means extending beyond said positioning under a component of said bed.

2. Apparatus as defined in claim 1 wherein said positioning means comprises a single elongated tubular member.

3. Apparatus as defined in claim 2 wherein said elongated tubular member is attached to said handle.

4. Apparatus as defined in claim 2 wherein the counteracting means is positioned at a right angle to said elongated tubular member.

5. Apparatus as defined in claim 4 wherein said counteracting means is an elongated bar that is slidably inserted through an aperture of said positioning means.

6. Apparatus as defined in claim 1 wherein the counteracting means comprises an elongated member associated with said handle and the positioning means.

7. Apparatus as defined in claim 1 wherein said handle comprises a tubular member that extends from a first positioning means to a second positioning means.

8. Apparatus as defined in claim 7 wherein said first positioning means is an elongated tubular member and said second positioning means is an elongated tubular member.

9. Apparatus as defined in claim 8 wherein said handle is asymmetric and reversible with respect to said first and second positioning means.

10. A method for assisting transfer into and out of a bed, comprising the steps of:

(a) providing a handle for engagement by a person seeking to transfer into or out of a bed;

(b) positioning said handle aside said bed and attaching said handle to means for securing said handle with respect to said bed; and (c) using an extended tubular member to counteract torque exerted by said handle when a person is seeking to transfer into or out of a bed; wherein the step of attaching said handle to the securing means comprises removably attaching said handle to said securing means.

11. The method as defined in claim 2 wherein the step of positioning and attaching said handle comprises positioning the attaching means under a component of said bed.

12. The method as defined in claim 2 wherein the step of positioning comprises positioning an elongated tubular member under a component of said bed.

13. The method as defined in claim 2 wherein the step of counteracting torque comprises inserting an elongated member with respect to said handle and the positioning means.

14. The method as defined in claim 13 further including the step of positioning the counteracting means at a right angle to said elongated member.

15. The method as defined in claim 14 further including the step of slidably inserting said counteracting means through an aperture.

16. The method as defined in claim 2 wherein the step of counteracting torque comprises providing a tubular member that extends from and beyond a first positioning means to and beyond a second positioning means.

17. The method as defined in claim 16 wherein the step of securing comprises providing said first positioning means as an elongated tubular member and said second positioning means as an elongated tubular member.

18. The method as defined in claim 17 wherein the step of providing said handle comprises providing an asymmetric and reversible member with respect to said first and second positioning means.

* * * * *